US009978549B1

(12) United States Patent
Tang

(10) Patent No.: US 9,978,549 B1
(45) Date of Patent: May 22, 2018

(54) VARIABLE VENTURI FLOW SWITCH

(71) Applicant: HYDRA-ELECTRIC COMPANY, Burbank, CA (US)

(72) Inventor: John Chick Hong Tang, Monterey Park, CA (US)

(73) Assignee: HYDRA-ELECTRIC COMPANY, Burbank, CA (US)

( * ) Notice: Subject to any disclaimer, the term of this patent is extended or adjusted under 35 U.S.C. 154(b) by 30 days.

(21) Appl. No.: 15/174,952

(22) Filed: Jun. 6, 2016

Related U.S. Application Data

(60) Provisional application No. 62/171,847, filed on Jun. 5, 2015.

(51) Int. Cl.
*H01H 35/26* (2006.01)

(52) U.S. Cl.
CPC .... *H01H 35/2614* (2013.01); *H01H 35/2692* (2013.01)

(58) Field of Classification Search
CPC .... F15B 7/00; F15B 2211/426; F15B 2211/60
USPC ..... 200/81.9 R; 91/418; 60/325; 137/101.21; 251/28, 62, 63.6
See application file for complete search history.

(56) References Cited

U.S. PATENT DOCUMENTS 4,335,737 A * 6/1982 Power ..... B01F 3/088 123/25 E

* cited by examiner

*Primary Examiner* — Vanessa Girardi
(74) *Attorney, Agent, or Firm* — Brooks Acordia IP Law, PC; Michael Zarrabian

(57) ABSTRACT

A flow switch including: a fluid inlet for receiving fluid in-line relative to a flow switch body; a poppet valve disposed in the fluid inlet and having a variable location relative to the flow switch body; an actuator pin affixed to the poppet valve; a helical spring disposed about the actuator pin, where the poppet valve is spring-loaded via the spring; and where the spring-loaded poppet valve is configured to move away from the fluid inlet with increasing volumetric fluid flow and towards the fluid inlet with decreasing volumetric fluid flow.

20 Claims, 4 Drawing Sheets

VARIABLE VENTURI FLOW SWITCH

CROSS-REFERENCE TO RELATED APPLICATIONS

This applications claims priority to and the benefit of U.S. Provisional Application No. 62/171,847, filed Jun. 5, 2015, the disclosure of which is incorporated by reference herein for all purposes.

TECHNICAL FIELD

The invention, in its several embodiments, pertains to switches, and more particularly to fluid flow switches.

BACKGROUND

A pressure switch is a form of switch that closes an electrical contact when a certain set pressure has been reached on its input. The switch may be designed to make contact either on pressure rise or on pressure fall. The switch may detect pressure rise in various media such as fluids.

SUMMARY

An exemplary flow switch may include: a fluid inlet for receiving fluid in-line relative to a flow switch body; a poppet valve disposed in the fluid inlet and having a variable location relative to the flow switch body; an actuator pin affixed to the poppet valve; a helical spring disposed about the actuator pin, wherein the poppet valve may be spring-loaded via the spring; where the poppet valve may be configured to move away from the fluid inlet with increasing volumetric fluid flow and towards the fluid inlet with decreasing volumetric fluid flow.

In additional exemplary flow switch embodiments, the fluid may exit the flow switch transversely relative to the flow switch body. In additional exemplary flow switch embodiments, a movement of the poppet valve away from the fluid inlet may open up a throat area of the fluid inlet past the poppet valve. In additional exemplary flow switch embodiments, a movement of the poppet valve towards the fluid inlet may restrict flow at a throat area of the fluid inlet past the poppet valve.

Additional exemplary flow switch embodiment may include an adjustment screw, where rotation of the adjustment screw in a clockwise direction may increase spring rate on the poppet valve, and where rotation of the adjustment screw in a counterclockwise direction may decrease spring rate on the poppet valve. In additional exemplary flow switch embodiments, a measurable flow rate of the flow switch may be adjustable between 1 gallon per minute (GPM) and 15 GPM via the adjustment screw. In additional exemplary flow switch embodiments, the actuator pin may be hollow. In additional exemplary flow switch embodiments, the movement of the spring-loaded poppet valve away from the fluid inlet may allow larger fluid flow to pass a venturi tube. In additional exemplary flow switch embodiments, the movement of the spring-loaded poppet valve towards the fluid inlet may allow lower fluid flow to pass a venturi tube.

In additional exemplary flow switch embodiments, the movement of the spring-loaded poppet valve away from the fluid inlet may actuate a disk spring. In additional exemplary flow switch embodiments, the disk spring may be calibrated to snap deflect at an upper pressure limit and a lower pressure limit. In additional exemplary flow switch embodiments, the snap deflection may be transmitted through a hermetically sealed pivoting wobble-arm actuator assembly to a micro-switch. In additional exemplary flow switch embodiments, the micro-switch may actuate an internal over center, snap-action electrical contact for opening or closing an electric circuit in response to the transmitted snap deflection.

In additional exemplary flow switch embodiments, the poppet valve may have a conical upper surface, and the actuator pin may be affixed to the upper surface of the poppet valve. In additional exemplary flow switch embodiments, the poppet valve may have a conical lower surface. In additional exemplary flow switch embodiments, the lower surface of the poppet valve may include an extension. In additional exemplary flow switch embodiments, the extension on the lower surface of the poppet valve may be guided by a piston guide to laterally restrain the poppet valve such that it only moves in-line relative to the flow switch body based on a fluid flow rate.

BRIEF DESCRIPTION OF THE DRAWINGS

Embodiments of the present invention are illustrated by way of example and not limitation in the figures of the accompanying drawings, which may not be drawn to scale, and in which.

DETAILED DESCRIPTION

Figure 1C:
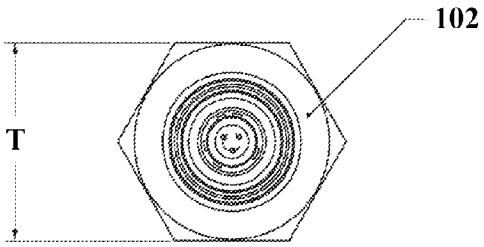
FIG. 1C is a top view of the switch of FIG. 1A.

The description herein is made for the purpose of illustrating the general principles of the embodiments discloses herein and is not meant to limit the concepts disclosed herein. Further, particular features described herein can be used in combination with other described features in each of the various possible combinations and permutations. Unless otherwise specifically defined herein, all terms are to be given their broadest possible interpretation including meanings implied from the description as well as meanings understood by those skilled in the art and/or as defined in dictionaries, treatises, etc.

One embodiment of a flow switch 50 disclosed herein includes: a fluid inlet 33 for receiving fluid in-line relative to a flow switch body 4; a poppet valve 2 disposed in the fluid inlet 33 of a fluid entry opening 110, and having a variable location relative to the flow switch body 4 in response to fluid flow rate against the valve 2; an actuator pin 5 affixed to the poppet valve 2; a helical spring 3 disposed about the actuator pin 5, where the poppet valve 2 is spring-loaded via the helical spring 3. As shown by example in FIG. 1A, fluid flows through bottom fluid entry opening 110 to the switch 50 essentially in-line with axis 220 of the body 4, urging pressure against a lower surface 1L of the valve 2. Fluid may then flow out of one or more side fluid exit openings 112, transverse (e.g., perpendicular) to the axis 220 of the body 4.

In response to fluid flow rate (i.e., fluid pressure), the poppet valve 2 is configured to move away from the fluid inlet 33 with increasing volumetric fluid flow against the valve 2 via inlet 33, and back towards the fluid inlet 33 with decreasing volumetric fluid flow against the valve 2 via inlet 33.

The fluid exits sides of the flow switch 50 transversely, such as perpendicular (e.g., horizontally when axis 220 is normal to ground), relative to the longitudinal axis 220 of the flow switch body 4. A movement of the poppet valve 2 away from the fluid inlet 33 opens up the throat area 31 of the fluid inlet 33, allowing fluid to flow past the poppet valve 2. A movement of the poppet valve 2 toward the fluid inlet 33 restricts flow at the throat area 31 of the fluid inlet 33 past the poppet valve 2. Increasing fluid flow rate into the inlet 33 (and Venturi compression zone proximate throat 31) applies more pressure on the valve 2, and at a set pressure overcomes the force of spring 3 and moves the valve 2 away from throat 31, allowing fluid to enter into the recovery zone 32 and out of the side exits 112.

The flow switch 50 may also include an adjustment screw 7. Rotation of the adjustment screw 7 in a clockwise direction increases spring rate on the poppet valve, and rotation of the adjustment screw 7 in a counterclockwise direction decreases spring rate on the poppet valve 2, from a bottom position, or vice versa in some embodiments. A measurable flow rate of the flow switch 50 may be adjustable between 1 gallon per minute (GPM) and 15 GPM via the adjustment screw 7. The actuator pin 5 may be hollow.

The movement of the spring-loaded poppet valve 2 away from the fluid inlet allows larger fluid flow to pass a venturi tube 200. The movement of the spring-loaded poppet valve 2 towards the fluid inlet allows lower fluid flow to pass a venturi tube 200. The movement of the spring-loaded poppet valve 2 away from the fluid inlet allows higher fluid flow to pass the venturi tube 200. The disk spring 29 is calibrated to snap deflect at an upper pressure limit and a lower pressure limit. The snap deflection is transmitted through a hermetically sealed pivoting wobble-arm actuator assembly 14 to a micro-switch 17. The micro-switch 17 actuates an internal over center, snap-action electrical contact for opening or closing an electric circuit in response to the transmitted snap deflection.

The poppet valve 2 has a conical upper surface 1U, and the actuator pin 5 is affixed to the upper surface 1U of the poppet valve 2. The poppet valve 2 has a conical lower surface 1L. The lower surface 1L of the poppet valve 2 comprises an extension. The extension on the lower surface 1L of the poppet valve 2 is guided by a piston guide 1 to laterally restrain the poppet valve 1L such that it only moves in-line relative to the flow switch body based on a fluid flow rate.

Embodiments of a variable Venturi flow switch are disclosed herein. The Venturi effect is the reduction in fluid pressure that results when a fluid flows through a constricted section of a tube.

The poppet valve 2 is spring-loaded via spring 3, and is situated within a cone shaped inlet 33 of a Venturi compression zone in the switch 50 before a throat area 31.

The inlet pressure is tapped at the entrance of the variable Venturi flow switch body 4. Specifically, the low pressure inlet 31 is tapped at the poppet valve 2. As the flow increases, the compression of the fluid causes the poppet valve 2 to (compress spring 3) and change its position whereby the variable Venturi flow switch 50 senses different flow rates (different fluid pressures).

The venturi tube section 200 includes a piston guide 1, a poppet valve 2, a helical spring 3, an actuator pin 5 attached to the poppet valve 2, and an adjustment screw 7 for adjust the spring rate on the poppet valve 2. Movement of the spring-loaded poppet valve 2 away from the fluid inlet 33 allows larger fluid flow to pass a throat area 31 of the Venturi tube section 200. As the fluid flow increases, the compression of the fluid causes the poppet valve 2 to move away from the fluid inlet 33, and this movement can be used to sense an increase in fluid flow rate. Movement of the spring-loaded poppet valve 2 towards the fluid inlet allows lower fluid flow to pass a throat area 31. As the fluid flow decreases, the compression of the fluid causes the poppet valve 2 to move towards the fluid inlet 33, and this movement can be used to sense a decrease in fluid flow rate.

The inlet pressure is tapped at the entrance 110 of the variable Venturi flow switch body 4. The Venturi flow switch 50 senses different flow rates (different fluid pressures). In operation, fluid flows into a cone shaped inlet 33 of the Venturi compression zone in the switch 50 before a throat area 31. With increasing flow rate, the fluid flows past the throat area 31 and valve 2, into a recovery zone 32 of tube 200 above the upper surface 1U of the valve 2.

Figure 1B:
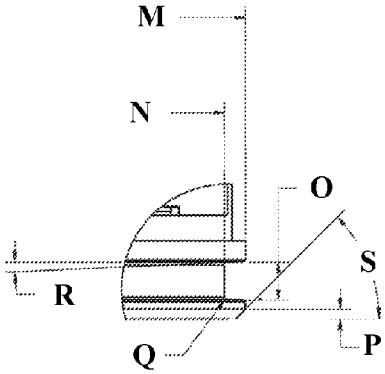
FIG. 1B is an enlarged detail view of the switch of FIG. 1A about detail B.
Figure 1A:
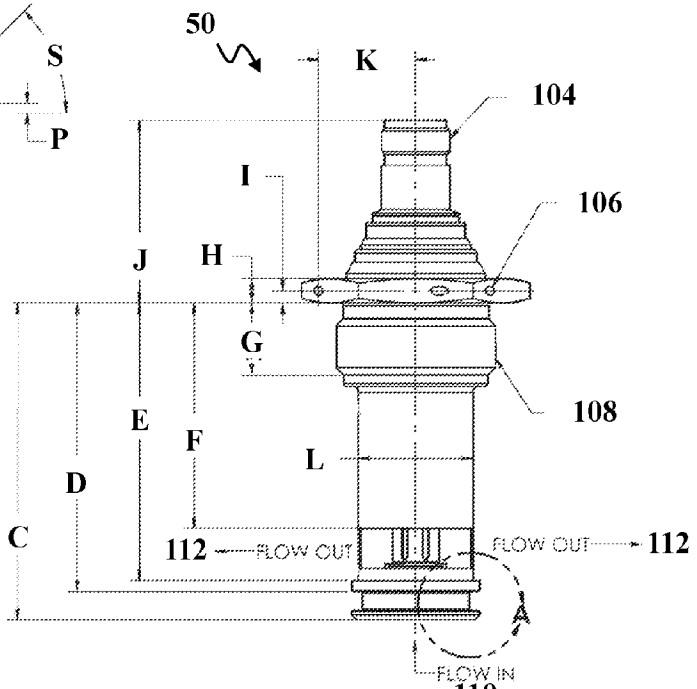
FIG. 1A is a side view of an embodiment of a variable venturi flow switch.
Figure 1D:
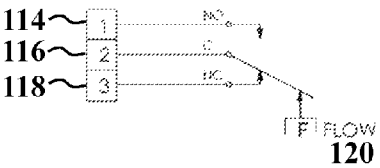
FIG. 1D is a wiring diagram of the switch of FIG. 1A.

Example embodiments of the variable Venturi flow switch are disclosed herein below and in the accompanying drawings. FIG. 1A is a side view of an embodiment of a variable Venturi flow switch 50, according to one embodiment. FIG. 1B is an enlarged detail view of the switch 50 of FIG. 1A about detail A. FIG. 1C is a top view of the switch 50 of FIG. 1A. FIG. 1D is a simple wiring diagram of the switch 50 of FIG. 1A in an electrical circuit, wherein the switch 50 can close an electrical contact when a certain set pressure has been reached on its input. The switch 50 may be designed to make contact either on pressure rise (e.g., high pressure) or on pressure fall (e.g., low pressure).

In one embodiment, the variable Venturi flow switch is a snap action, stainless steel flow switch suitable for operation of any media (e.g., fluid) at any altitude (e.g., for aircraft applications). The variable Venturi flow switch comprises flow switch body 4 and a differential pressure switch 17 disposed in the flow switch body. Changes in system fluid flow rate are sensed whereby the differential pressure switch 17 is activated when the fluid flow rate exceeds a specified value.

Figures 2A, 2B, 2C:
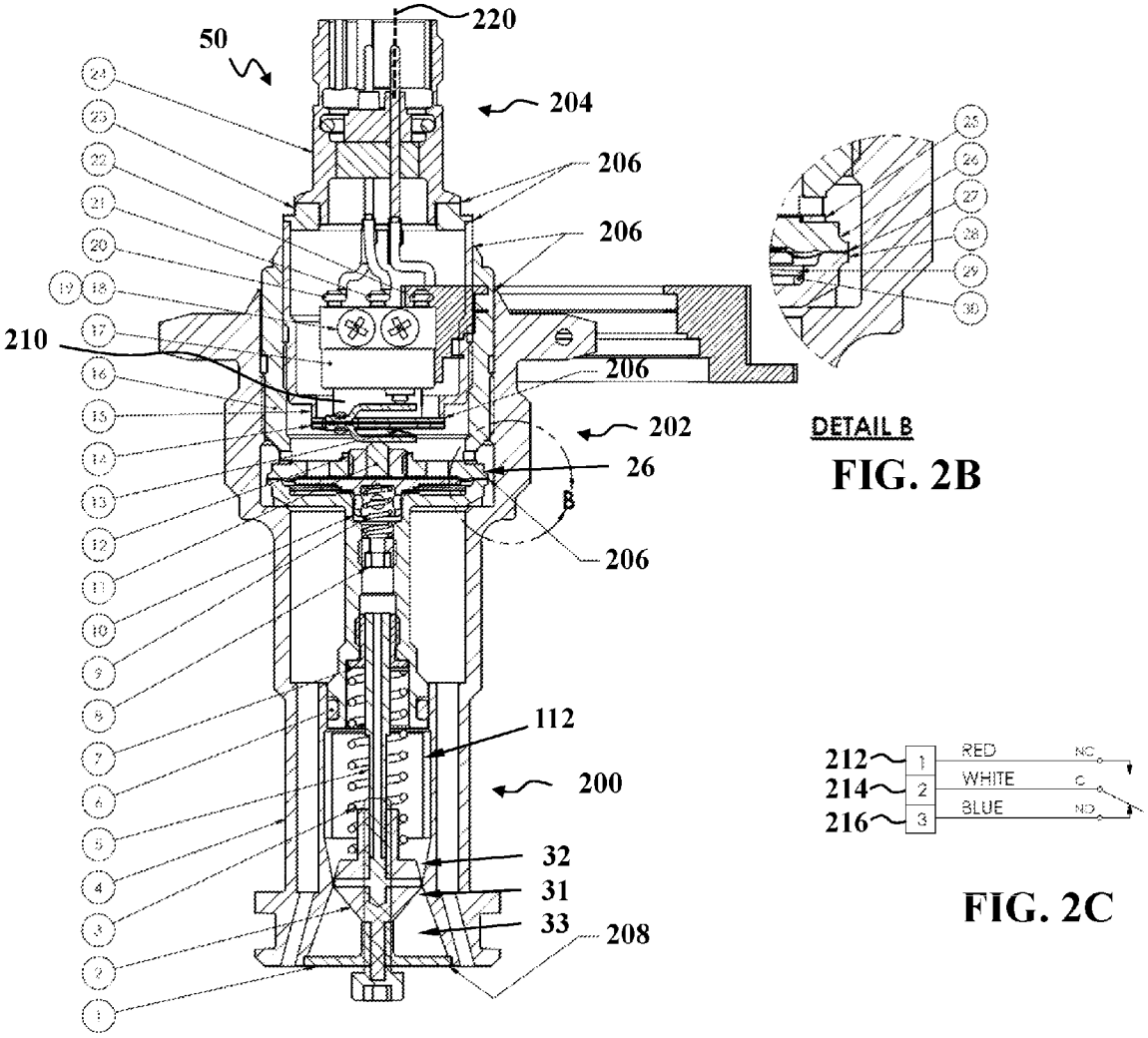
FIG. 2A shows a lengthwise cross-section view of the switch of FIG. 1A.
FIG. 2B is an enlarged detail cross-section view of the switch of FIG. 2A about detail B.
FIG. 2C is a wiring diagram of the switch of FIG. 2A.

FIG. 2A shows a lengthwise cross-section view of the switch 50 of FIG. 1A, and FIG. 2B shows an enlarged detail cross-section view of the switch 50 of FIG. 2A about detail B. FIG. 2C is a wiring diagram of the switch 50 of FIG. 2A. The three contacts 212, 214, 216 may correspond to wires 20, 21, 22, respectively. The switch 50 includes three electrical contacts 212, 214, 216. In one embodiment, increasing fluid flow (increasing fluid pressure) to the switch 50 may break contacts 214, 216 and close contacts 212, 214.

Figure 3B:
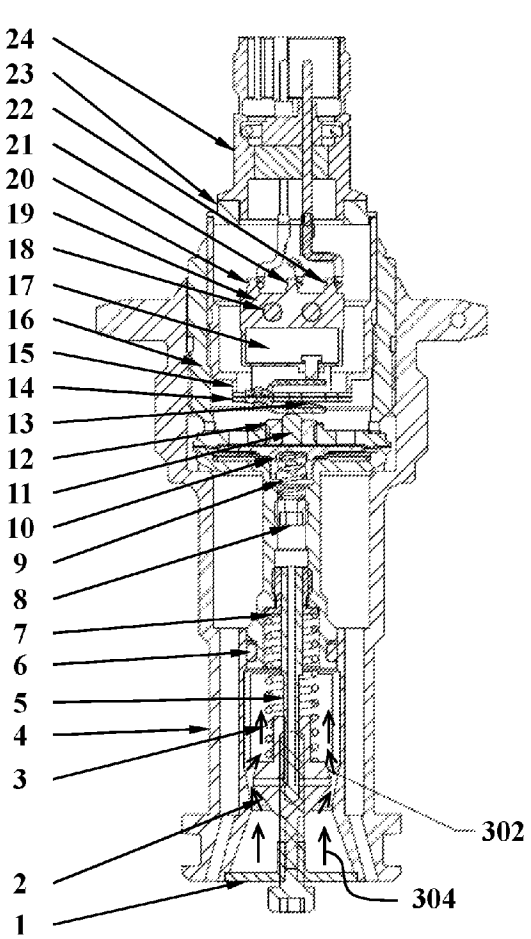
FIG. 3B shows a high fluid flow condition in the switch of FIG. 1A.
Figure 3A:
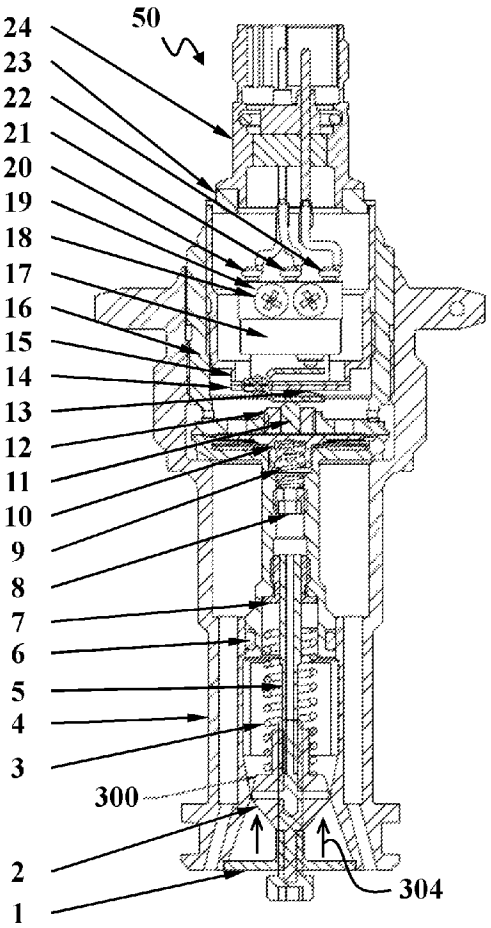
FIG. 3A shows a low fluid flow condition in the switch of FIG. 1A.
Figure 4:
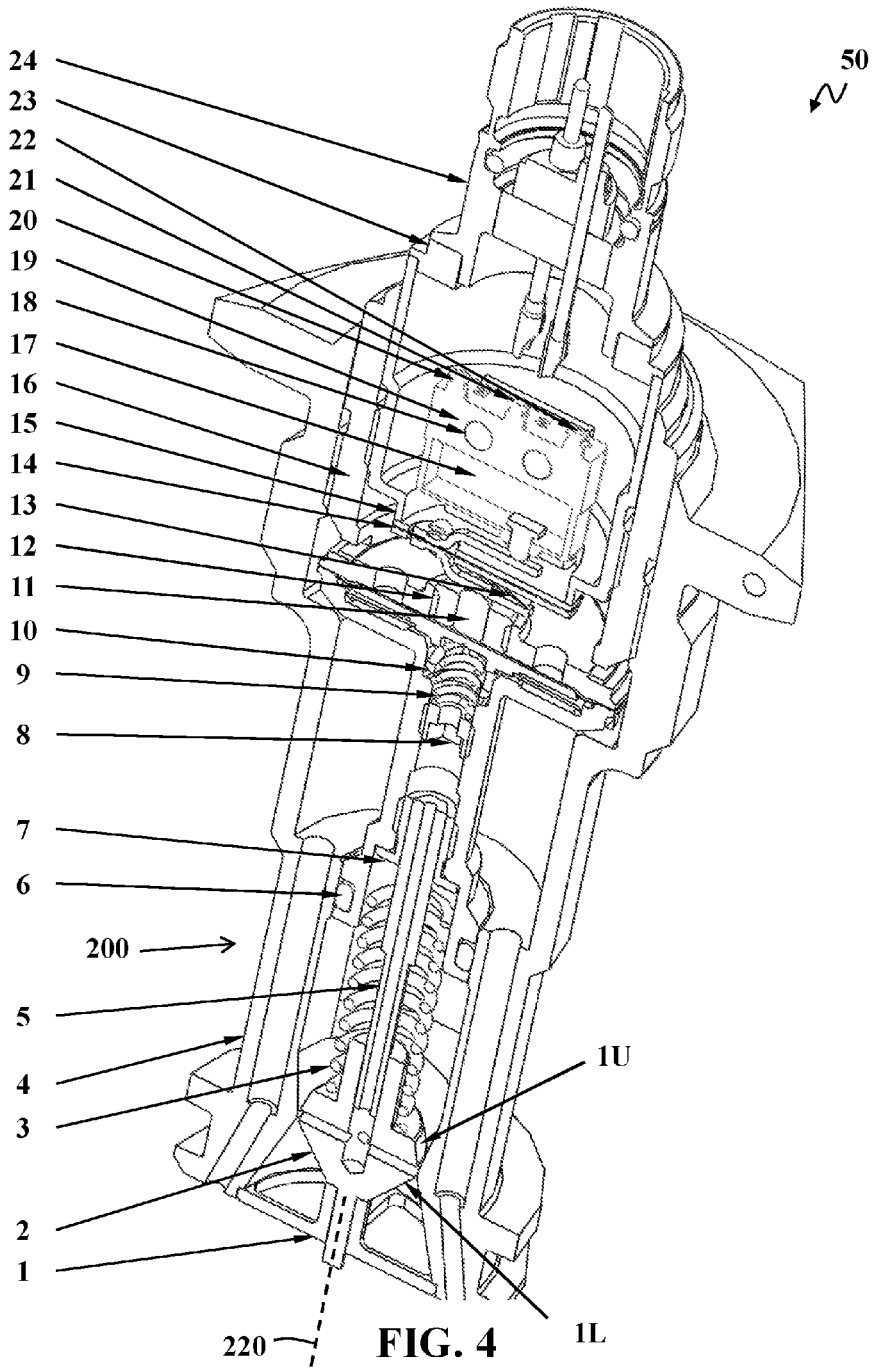
FIG. 4 shows a perspective lengthwise cross-section view of the switch of FIG. 1A.

FIGS. 3A-3B show example operational modes of the switch 50, according to one embodiment. Specifically, FIG. 3A shows a low fluid flow condition (low fluid pressure) in the switch 50 of FIG. 1A, and FIG. 3B shows a high fluid flow (high fluid pressure) condition in the switch 50 of FIG. 1A. Further, FIG. 4 shows a perspective lengthwise cross-section view of the switch 50 of FIG. 1A.

Referring to the drawings, the switch 50 comprises three main sections: a Venturi tube section 200, an actuating-mechanism section 202, and an electrical section 204. In one embodiment, sections of the switch 50 may be laser welded 206 or Tungsten Inert Gas (TIG) welded 208.

Referring to FIGS. 2A-2B, 3A-3B and 4, in one embodiment, the Venturi tube section 200 includes a piston guide 1, a poppet valve 2, a helical spring 3, an actuator pin 5 attached to the poppet valve 2, and an adjustment screw 7 for adjust the spring rate on the poppet valve 2.

The poppet valve 2 is spring-loaded via spring 3, and is situated within a cone shaped inlet 33 of a Venturi compression zone in the switch 50 before a throat area 31. The poppet valve 2 is configured to move with increasing flow to suit specific flow applications, as described in more detail herein.

The poppet valve 2 includes a conical lower surface 1L with an extension guided by a piston guide 1 to restrain lateral movement of the poppet valve 2, such that poppet valve 2 only moves in-line along the length of the switch 50 (i.e., up and down in the drawing page) depending on the fluid flow rate. The poppet valve 2 further includes a conical upper surface 1U and a connected actuator pin 5.

In one embodiment, the actuating mechanism section 202 comprises a switch body 4, an o-ring 6, an adjustment screw 8, a helical spring 9, a pressure plate 10, a pin 11, a lock nut 12, a load spring 13 located on a lower hinge arm of a switch actuator assembly 14 including a lower hinge arm and an upper hinge arm, a register ring 30 supporting the edges of a disk spring 29 so the spring can pivot, a fitting 28, a diaphragm 27, a ring 26, and a ring spacer 25.

The variable Venturi flow switch 50 includes said poppet valve 2, affixed at the end of the actuator pin (e.g., hollow shaft) 5 which is spring loaded via spring 3. The position of the poppet valve 2 within the switch 50 changes (i.e., moving up/down the tube 4) based on sensed pressure. The valve 2 is used to change the flow area, such that the volumetric flow rate becomes a design parameter which can be changed while maintaining an overall high pressure recovery rate and steady pressure drop.

Movement of the poppet valve 2 and actuator pin 5 from flow rate is transferred through to the helical spring 9, pressure plate 10, pin 11, and switch actuator assembly 14. The lower hinge arm of the switch actuator assembly 14 remains in contact with the pin 11.

FIG. 3A shows a low fluid flow condition in the switch 50 of FIG. 1A. The spring loaded poppet valve 2 restricts flow at throat area 300 in low flow conditions. FIG. 3B shows a high fluid flow condition in the switch 50 of FIG. 1A. The spring loaded poppet valve 2 is pushed back (i.e., upwards relative to the switch 50) at high flow conditions, which enables the throat area 302 to open up. Fluid flow 304 is shown by arrows in FIGS. 3A-3B.

At fluid flow rates (fluid pressures) higher than a threshold value, the poppet valve 2 is pushed away from the fluid inlet, such that actuator pin moves towards a pressure plate 10, and the throat area 31 opens up (FIG. 3B). The adjustment screw 7 may be adjusted to measure different flow rates. To measure a higher flow rate, the spring rate may be increased. A traditional switch may have a set flow measuring rate, such as 1 GPM+/−0.1 GPM.

In one embodiment, the electrical section 204, which is hermetically sealed, includes electrical case 15, a register 16, a micro-switch 17, two screws 18, a nut plate 19, three wires 20, 21, 22 (e.g., 24 American wire gauge (AWG) red, blue and white, respectively), a receptacle spacer 23, and a receptacle 24 along with the switch actuator assembly 14 forms a hermetically sealed chamber 210. The upper hinge arm of the switch actuator assembly 14 may remain contact with the plunger of the micro-switch 17, whereby movement of the pin 11 is transferred through to the plunger of the micro-switch 17 to switch the open contacts of the micro-switch (e.g., FIGS. 1D and 1C).

FIG. 3A shows a low fluid flow condition in the switch 50 of FIG. 1A. The spring loaded poppet valve 2 restricts flow at throat area 300 in low flow conditions. FIG. 3B shows a high fluid flow condition in the switch 50 of FIG. 1A. The spring loaded poppet valve 2 is pushed back (i.e., upwards relative to the switch 50) at high flow conditions, which enables the throat area 302 to open up. Fluid flow 304 is shown by arrows in FIGS. 3A-3B.

As noted, the poppet valve 2 is spring loaded via spring 3, situated within a cone shaped inlet 33 of the Venturi compression zone in the switch before a throat area 31, such that in response to increased fluid flow, the poppet valve 2 compresses spring 3 and moves to cause opening/closing electrical contacts, as described herein.

The inlet pressure is tapped at the entrance of the variable Venturi flow switch body 4. Specifically, the low pressure inlet 31 is tapped at the poppet valve 2. As the flow increases, the compression of the fluid causes the poppet valve 2 to (compress spring 3) and change its position whereby the variable Venturi flow switch 50 senses different flow rates (different fluid pressures).

An applied differential fluid pressure bears on opposite sides of a semi-limp stainless steel sensing diaphragm 27 (FIG. 2B) which bears on a supporting pressure plate 10, which in turn exerts a force on a disk spring 29 (directly above the register ring 30, which supports the edges of the disk spring 29 so the disk spring 29 can pivot), and also exerts force on the rest of the spring force adjustment mechanism, including screw 8 and helical spring 9.

Fluid reaches the diaphragm 27 from the high pressure tab (body of the switch) and low pressure tab from the poppet valve 2, with the low-pressure side (lower diaphragm surface) just above pressure plate 10 and the high-pressure side (upper diaphragm surface) just below pin 11.

A spring loaded adjustment screw 8 can be adjusted in the poppet valve 2 to allow different spring rates of the disk spring 29 to snap actuate at different pressure settings to accommodate different flows. Rotation of the adjustment screw 8 in a clockwise direction increases spring rate on the helical spring 9, and rotation of the adjustment screw 8 in a counterclockwise direction decreases spring rate on the helical spring 9, relative to an upright position of the flow switch, or vice versa.

The disk spring 29 is calibrated to snap deflect at two prescribed differential pressures (e.g., one at an upper pressure limit and the other at a lower pressure limit).

When the pressure from the high pressure side (area above the diaphragm 27) is sufficiently greater than a low pressure reference (area below the diaphragm), the disk spring 29 is overcome and the diaphragm 27, pressure plate 10 and disk spring 29 "snap" deflects away from the applied high pressure towards the wobble arm assembly 14 to a micro-switch 17.

The snap movement is transmitted through a hermetically sealed pivoting wobble-arm actuator assembly 14 to the micro-switch 17 which in turn actuates its internal over center, snap-action electrical contacts (not shown) for closing/opening connected electrical circuits.

When the pressure differential subsides to a predetermined level, the disk spring 29 movement reverses itself by snap deflecting back to its original position. A spring loaded adjustment screw 8 can be adjusted in the poppet valve 2 to allow different spring rates of the disk spring 29 to snap actuate at different pressure settings to accommodate different flows. Rotation of the adjustment screw 8 in a clockwise direction increases spring rate on the helical spring 9, and rotation of the adjustment screw 8 in a counterclockwise direction decreases spring rate on the helical spring 9, relative to an upright position of the flow switch, or vice versa.

Further, a range of fluid flow rates to be sensed can be selected based on the location/position of the poppet valve 2 in the tube 4 for actuation and de-actuation pressures making the variable Venturi flow switch 50 a versatile option for pressure and flow sensing applications.

In operation, fluid flows into a cone shaped inlet 33 of the Venturi compression zone in the switch 50 before a throat area 31. The fluid exits the throat area and into a recovery zone 32. The inlet pressure is tapped at the entrance of the variable Venturi flow switch body 4. As notes, the poppet valve 2 is spring-loaded and configured to move with increasing flow to suit specific flow applications. The disclosed switch 50 may be varied to a high range (e.g., 1 GPM to 15 GPM) using the adjustment screw 7. Rotation of the adjustment screw 7 in a clockwise direction increases spring rate of the spring 3 urging poppet valve 2, and rotation of the adjustment screw 7 in a counterclockwise direction decreases spring rate on the poppet valve 2, thereby allowing differing flow applications.

As the fluid flow pressure increases, the compression of the fluid causes the poppet valve 2 to change its position enabling the variable Venturi flow switch to sense different flow rates. The Venturi section 200 is oriented in-line relative to the switch 50 with fluid flowing upwards and exiting at about 90° angles relative to fluid flow into the switch 50. The switch 50 has a Venturi section 200 oriented in-line with the actuating-mechanism section 202 and the electrical section 204, and is therefore smaller than conventional switched. The Venturi section 200 is oriented in-line relative to the body 4 and differential switch (11, 12, 10, 9, 8, 25, 26, 27, 28, 29, 30) aligned along axis 220 (FIGS. 2A, 4). In-line generally means in axis or oriented in parallel or with concentric longitudinal axis (long axis) 220 of the switch 50, aligned along axis 220.

FIG. 1D is a wiring diagram of the switch 50 of FIG. 1A. The switch 50 may have three electrical contacts 114, 116, 118. Contacts 116, 118 are closed with flow 120 at or below a set flow (e.g., 1 gallon per minute (GPM)). On increasing flow, contacts 116, 118 may be open and contacts 114, 116 may close.

In one example, electrical contacts of the switch 50 may close on decreasing flow by 1 GPM maximum. On increasing flow the switch contact shall open by 5 GPM min. In one example, the operational oil temperature of the switch 50 may range from about 200° F. to 350° F. with about 475° F. upper limit emergency. The temperature range of the switch 50 may be from about 60° F. to 350° F. with about 475° F. upper emergency limit.

In one example, the normal pressure may be about 134 pounds per square inch gage (PSIG), proof may be about 400 PSIG, and burst may be at about 800 PSIG. Pressure drop in flow direction with MIL-PRF-85734 at 200° F., maximum pressure drop may be about 25 PSI at about 14 GPM. The electrical rating may be about 1 AMP resistive at 28 VDC. The weight may be about 10.0 oz maximum. The switch 50 may be capable of pressure fluctuations of about 810 to −10 PSIG at about 329 HZ.

In one the switch 50 comprises one or more of the following example approximate exterior dimensions, wherein: dimension C is about 2.50 in. to 2.61 in., dimension D is about 2.36 in. to 2.38 in., dimension E is about 2.27 in. to 2.29 in., dimension F is about 1.5 in. to 2.00 in., dimension G is about 0.58 in. to 0.60 in., dimension H is about 0.18 in. to 0.22 in., dimension I is about 0.08 in. to 0.12 in. for three places, dimension J is 1.50 in. max, dimension K is about 0.800 in.+/−0.010 in. for three places, dimension L is Ø.949 in. max, dimension M is about Ø1.050 in. to 1.051 in., dimension N is about Ø.877 in. to 0.879 in., dimension O is 0.148 in. to 0.154 in., dimension P is about 0.035 in. to 0.045 in., dimension Q is R.005 in. to 0.015 in., dimension R is about 0° to 5°, dimension S is about 45°, dimension T is about 1.625 in.+/−0.010 in. hex.

The switch 50 may also have an identification 102, an electrical receptacle 104 (e.g., EN2997YE10803MN), lockwire holes 106 having a dimension of about Ø.070 in. in three places, and a threaded port fitting 108 (e.g., 1.3125-12 UNJ-3A).

Those skilled in the art will appreciate that various adaptations and modifications of the described preferred embodiments can be configured without departing from the scope and spirit of the improved pressure switch system described herein. Therefore, it is to be understood that, within the scope of the embodiments, the switch system may be practiced other than as specifically described herein.

What is claimed is:

1. A flow switch comprising:

a fluid inlet for receiving fluid in-line relative to a flow switch body;

a poppet valve disposed in the fluid inlet and having a variable location relative to the flow switch body;

an actuator pin affixed to the poppet valve;

a helical spring disposed about the actuator pin, wherein the poppet valve is spring-loaded via the helical spring; and an adjustment screw, wherein rotation of the adjustment screw in a first direction relative to a bottom position of the flow switch increases spring rate on the poppet valve, and wherein rotation of the adjustment screw in a second opposite direction relative to the bottom position of the flow switch decreases spring rate on the poppet valve;

wherein the poppet valve is configured to move away from the fluid inlet with increasing volumetric fluid flow and towards the fluid inlet with decreasing volumetric fluid flow.

2. The flow switch of claim 1 wherein the fluid exits the flow switch transversely relative to the flow switch body.

3. The flow switch of claim 1 wherein a movement of the poppet valve away from the fluid inlet opens up a throat area of the fluid inlet.

4. The flow switch of claim 1 wherein a movement of the poppet valve towards the fluid inlet restricts flow at a throat area of the fluid inlet past the poppet valve.

5. The flow switch of claim 1 wherein a measurable flow rate of the flow switch is adjustable between 1 gallon per minute (GPM) and 15 GPM via the adjustment screw.

6. The flow switch of claim 1 wherein the actuator pin is hollow.

7. The flow switch of claim 1 wherein the movement of the spring-loaded poppet valve away from the fluid inlet allows larger fluid flow to pass a throat area.

8. The flow switch of claim 1 wherein the movement of the spring-loaded poppet valve towards the fluid inlet allows lower fluid flow to pass a throat area.

9. A flow switch comprising:

a fluid inlet for receiving fluid in-line relative to a flow switch body;

a poppet valve disposed in the fluid inlet and having a variable location relative to the flow switch body;

an actuator pin affixed to the poppet valve; and a helical spring disposed about the actuator pin, wherein the poppet valve is spring-loaded via the helical spring;

wherein the poppet valve is configured to move away from the fluid inlet with increasing volumetric fluid flow and towards the fluid inlet with decreasing volumetric fluid flow, and wherein the movement of the spring-loaded poppet valve away from the fluid inlet actuates a disk spring.

10. The flow switch of claim 9 wherein the disk spring is calibrated to snap deflect at an upper pressure limit and a lower pressure limit.

11. The flow switch of claim 10 wherein the snap deflection is transmitted through a hermetically sealed pivoting wobble-arm actuator assembly to a micro-switch.

12. A flow switch comprising:

a fluid inlet for receiving fluid in-line relative to a flow switch body;

a poppet valve disposed in the fluid inlet and having a variable location relative to the flow switch body;

an actuator pin affixed to the poppet valve; and a helical spring disposed about the actuator pin, wherein the poppet valve is spring-loaded via the helical spring;

wherein the poppet valve is configured to move away from the fluid inlet with increasing volumetric fluid flow and towards the fluid inlet with decreasing volumetric fluid flow, wherein the poppet valve has a conical upper surface, wherein the poppet valve has a conical lower surface, and wherein the actuator pin is affixed to the upper surface of the poppet valve.

13. The flow switch of claim 12 wherein the lower surface of the poppet valve comprises an extension.

14. The flow switch of claim 13 wherein the extension on the lower surface of the poppet valve is guided by a piston guide to laterally restrain the poppet valve such that it only moves in-line relative to the flow switch body based on a fluid flow rate.

15. A flow switch comprising:

a fluid inlet for receiving fluid in-line relative to a flow switch body;

a poppet valve disposed in the fluid inlet and having a variable location relative to the flow switch body;

an actuator pin affixed to the poppet valve, wherein the actuator pin is hollow; and a helical spring disposed about the actuator pin, wherein the poppet valve is spring-loaded via the helical spring;

wherein the poppet valve is configured to move away from the fluid inlet with increasing volumetric fluid flow and towards the fluid inlet with decreasing volumetric fluid flow.

16. The flow switch of claim 15 wherein the fluid exits the flow switch transversely relative to the flow switch body.

17. The flow switch of claim 15 wherein a movement of the poppet valve away from the fluid inlet opens up a throat area of the fluid inlet past the poppet valve, and wherein a movement of the poppet valve towards the fluid inlet restricts flow at a throat area of the fluid inlet past the poppet valve.

18. The flow switch of claim 15 further comprising:

an adjustment screw, wherein rotation of the adjustment screw in a first direction relative to a bottom position of the flow switch increases spring rate on the poppet valve, and wherein rotation of the adjustment screw in a second opposite direction relative to the bottom position of the flow switch decreases spring rate on the poppet valve.

19. The flow switch of claim 15 wherein a measurable flow rate of the flow switch is adjustable between 1 gallon per minute (GPM) and 15 GPM via the adjustment screw.

20. The flow switch of claim 15 wherein the movement of the spring-loaded poppet valve away from the fluid inlet allows larger fluid flow to pass a throat area, and wherein the movement of the spring-loaded poppet valve towards the fluid inlet allows lower fluid flow to pass a throat area.

* * * * *